United States Patent [19]

Croyle

[11] Patent Number: 4,658,144

[45] Date of Patent: Apr. 14, 1987

[54] SYSTEM FOR ALIGNMENT AND FEEDING COOPERATING FABRIC PARTS IN SEWING OPERATIONS

[75] Inventor: Gene F. Croyle, Plano, Tex.

[73] Assignee: Levi Strauss & Co., San Francisco, Calif.

[21] Appl. No.: 756,392

[22] Filed: Jul. 17, 1985

[51] Int. Cl.[4] ..... G01N 21/86; G01V 9/04

[52] U.S. Cl. ..... 250/548; 250/561

[58] Field of Search ..... 250/548, 557, 561; 112/121.11, 121.12, 121.14; 226/24; 356/400

[56] References Cited

U.S. PATENT DOCUMENTS

| | | | |
|---|---|---|---|
| 2,078,669 | 4/1937 | King . | |
| 2,106,611 | 1/1938 | La Pierre . | |
| 2,106,612 | 1/1938 | La Pierre et al. . | |
| 2,117,878 | 5/1938 | Friedemann . | |
| 2,674,151 | 4/1954 | Garrett et al. . | |
| 2,962,596 | 11/1960 | Leimer et al. . | |
| 3,323,700 | 6/1967 | Epstein et al. | 250/548 |
| 3,368,726 | 2/1968 | Funk et al. . | |
| 3,495,089 | 2/1970 | Brown . | |
| 3,559,568 | 2/1971 | Stanley | 250/548 |
| 3,867,889 | 2/1975 | Conner, Jr. | 250/548 |
| 4,157,477 | 6/1979 | Kall et al. | 250/548 |
| 4,184,080 | 1/1980 | Massey | 250/548 |
| 4,303,189 | 12/1981 | Wiley et al. | 250/548 |

*Primary Examiner*—David C. Nelms
*Assistant Examiner*—S. Allen
*Attorney, Agent, or Firm*—Hubbard, Thurman, Turner & Tucker

[57] ABSTRACT

Apparatus to align a plurality of objects while being concomitantly transported via a drive mechanism. Included is a detectional device at fixed locations in the path of transport to determine the relative actual positions of the objects and comparing the determined positions with a relative position to be maintained. On the basis of the comparison, the positional detection means emits a correction signal for operating a repositioning mechanism which imposes a restraining force on the leading of the objects that restrains the object in opposition to the transport force imposed thereon by the drive mechanism. For generating the emitted correction signal there is included circuit means including an encoder for generating pulses and means to determine the quantity of pulses corresponding to the variance between the compared portions of the objects. This enables high resolution monitoring to be effected whereby the restraining force imposed against the object can either be proportional to the magnitude of the correction signal or can be a fixed force applied by the repositioning mechanism for a proportioned time interval.

31 Claims, 10 Drawing Figures

SYSTEM FOR ALIGNMENT AND FEEDING COOPERATING FABRIC PARTS IN SEWING OPERATIONS

BACKGROUND

1. Field of the Invention

This invention relates to an apparatus for transporting and aligning objects and more specifically to an apparatus that aligns two objects as they are transported through a process.

2. Description of Related Art

In the apparel industry, the sewing of fabrics often require that the edges of two pieces of fabric be joined in a seam wherein the ends of these pieces must be even or matched within a very close tolerance after they are sewn together. Although these pieces may be cut precisely equal in length, several factors affect the overall matching of the edges after these fabrics have been sewn. These factors include the friction of the fabric passing through the machine and folding devices, varying characteristics of the fabrics themselves and the asymmetrical feed or pull that the sewing machine exerts on the top and bottom fabric pieces.

If after being sewn, a mismatch is produced between two fabrics which is greater than the next operation can correct or which does not meet the standard of quality in a case of a finishing operation, the piece is considered defective and the stitching must be ripped out and the pieces resewn.

If the length of the sewing operation is sufficient, the operator may control the tolerance to some extent by the application of tension or drag on one of the pieces of fabric as it is being sewn. However, it is very difficult to maintain a high degree of consistency because of the varying characteristics of materials from piece to piece, the high operating speed of modern sewing machines and operator fatigue. The shorter the length of the sew, the less manual correction that can be made because of both mechanical and physical response limitations. The existence of this alignment problem has in many incidences resulted in the abandonment of attempts to automate sewing operations in the apparel industry.

One object of the present invention is to provide an apparatus that automatically tracks material as it is being processed, generating a signal indicative of alignment and controlling alignment of the material.

SUMMARY OF THE INVENTION

In accordance with the present invention an apparatus to align a plurality of objects is provided that includes a transport device for moving the objects over a predetermined path. The apparatus also includes a positional detection device located along the path for determining the actual positions of the objects and for providing an alignment correction signal. The apparatus further includes a repositioning device for altering the movement of at least one object along the path in response to the alignment correction signal.

In an embodiment of the present invention, an apparatus is provided that aligns a plurality of objects as they travel along a predetermined path and includes a positional detection device having a light source located along the path illuminating a plurality of light receivers wherein the passage of the objects along the path will initially block the light receivers from receiving light from the light source until the object has passed whereby the light receivers will then sequentially indicate that they are receiving light. The location of these light receivers along the path provide indications of the location of the end portions of the objects. These indications are provided to a circuit which determines when one object end is traveling ahead of another. This circuit provides a correction signal that includes a magnitude representative of the number of reference pulses occurring between the passage of one object end and the passage of another object end. This correction signal is then used by a repositioning device to restrain the travel of one of the objects relative to the travel of the other object until alignment is achieved.

In one enhancement, the repositioning device includes at least one mechanical arm positioned adjacent to the path of travel of one of the objects and applies pressure to the object in accordance to the correction signal to resist object travel. In this enhancement, the mechanical arm is connected to a transducer that produces movement of the arm as a result of receiving the correction signal. The transducer is connected to a pneumatic cylinder that initially positions the mechanical arm adjacent to the path. This enhancement may be configured to apply a force to the object to resist travel wherein the force is proportional to the magnitude of the correction signal or the full force may be applied until alignment is achieved.

In a second embodiment of the present invention, an apparatus is provided that aligns the end portions of two pieces of fabric as the fabric are being sewn together. In this apparatus, a transport device is provided to move the two pieces of fabric along a path that includes a first fabric path and a second fabric path. A fabric jig is provided to position one fabric above another fabric. This jig includes a positional detection apparatus that provides a plurality of position signals wherein each signal indicates the position of the end portion of the fabric as the fabrics travel through the jig. A reference pulse circuit is also provided that is connected to the transport device to indicate the fabric travel along the path. An offset circuit is connected to the reference pulse circuit and the positional detection device to provide a positional difference signal that indicates a relative positional difference between the end portions of the fabrics. The magnitude of this signal is related to the difference between the actual relative positional difference and a predetermined relative positional difference value. An alignment device is then provided for restraining the travel of at least one of the pieces of fabric as it travels along the path, the amount of restraint being proportional to the positional difference signal.

An enhancement of the above embodiment includes the alignment device having a mechanical arm that only restrains the travel of the lower piece of fabric. Another enhancement includes the positional detection device with two groups of position detectors where each position detector group includes several detector pairs, each pair being a light emitting device and a light receiving circuit that provides an indication when light is received. These pairs of each groups are located along the paths of travel of the upper and lower fabric pieces. As the fabric travels between the light emitters and the light receivers, each pair provides an indication when the end portion of the fabric has passed that pair location. The pairs of the upper fabric path are located in a corresponding relationship to that of the pairs of the lower fabric travel path. The offset circuit is connected to the pairs to measure the number of reference pulses that occur between the time that the end portion of one fabric passes one pair and the time the other end portion of the other fabric passes the corresponding pair. This number is provided as a correction signal to the alignment device which restrains the fabric in accordance with this time interval.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENTS

This invention relates to an apparatus that transports objects along a path and aligns the objects in accordance with the predetermined configuration.

Figure 1:
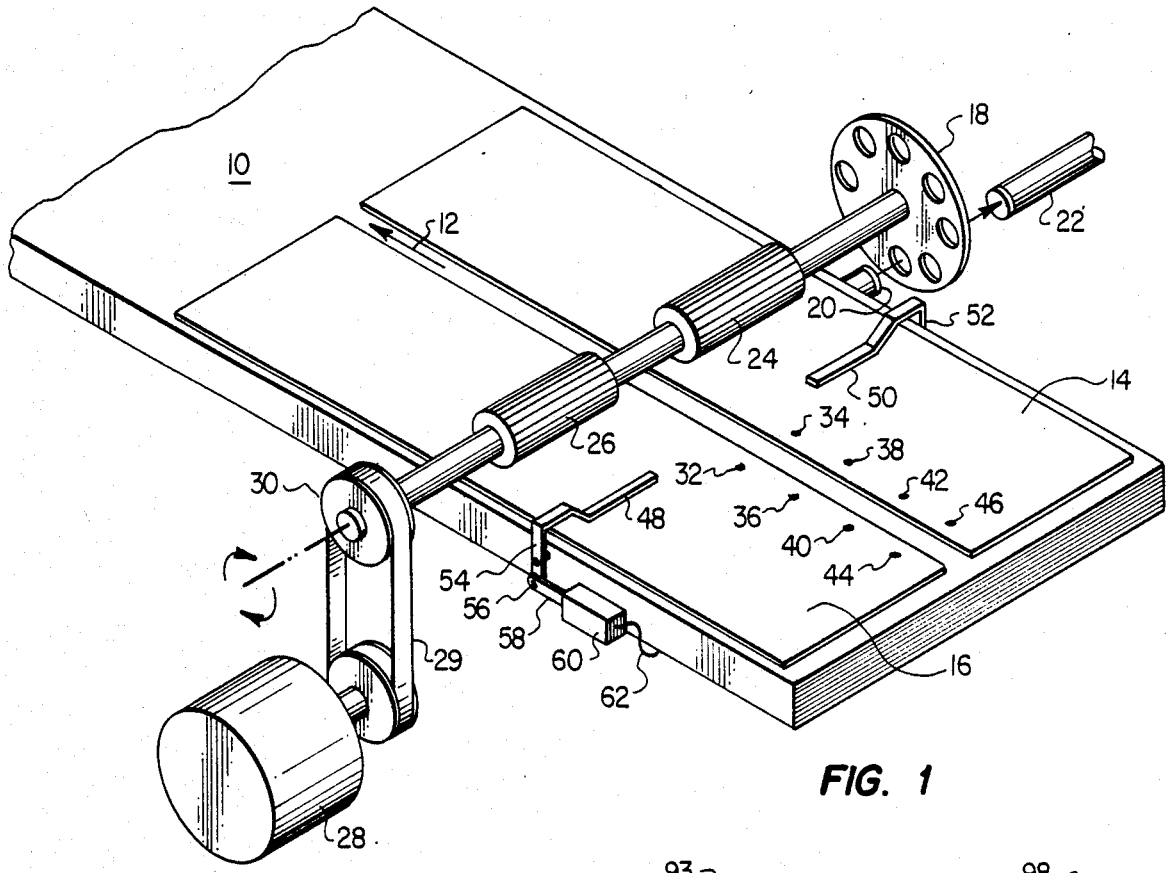
FIG. 1 is an isometric view of one embodiment of the present invention.

FIG. 1 is an illustration of one embodiment of the present invention. In FIG. 1, two pieces of fabric 14 and 16 are placed upon a table 10 and are transported across the table in a direction 12 by a transport mechanism that includes a motor 28 connected by a pulley 29 to a shaft 30 that rotates two grooved cylinders 24 and 26 that contact fabrics 14 and 16 respectively. The rotation of shaft 30 and cylinders 24 and 26 result in the movement of fabrics 14 and 16 across table 10. A light source 20 is positioned to provide light through an encoder disk 18 attached to shaft 30. A light receiver 22 is positioned opposite the light 20 to receive this light through the encoder disk 18 holes. The light pulses received by light receiver 22 indicate the motion of shaft 30 and the linear speed of the fabrics 14 and 16 as they travel along the table.

Each fabric path includes a mechanical arm 52 and 54 including a drag finger 50 and 48 located above the respective fabrics 14 and 16. The mechanical arms 52 and 54 are identical except for the arrangement over the respective sides of table 10 as shown. Only mechanical arm 54 will be discussed in more detail. The arm 54 is pivoted about axis 56 by linkage 58 that is connected to a transducer 60 positioned adjacent to table 10. Transducer 60 includes a signal line 62. When the signal is present on signal line 62, transducer 60 extends the linkage 58 outwardly causing the mechanical arm 54 to pivot about axis 56 causing the drag finger 48 to make contact with the fabric 16. The contact of the drag finger 48 against fabric 16 restrains the travel of fabric 16.

The positions of the end portions of fabrics 14 and 16 are determined by photo sensitive diodes 32, 34, 36, 38, 40, 42, 44 and 46 embedded in table 10 which, when uncovered, would be exposed to a light source above table 10 (not shown). When fabrics 14 and 16 are located above these photo sensitive devices, they do not receive light. As the fabric portions 14 and 16 travel along table 10, they will sequentially uncover the light receiving devices starting with devices 44 and 46 sequentially followed by 40 and 42, etc. As each light receiving device is uncovered, the light receiving device emits a signal indicating that it has received light and therefore the end portion of the fabric has passed. The position information is provided to a circuit (not shown) which determines when misalignment has occurred. This circuit accordingly provides a signal to either of the transducers of mechanical arms 52 and 54 to restrict the travel of the fabric pieces to restore alignment.

In the embodiment of FIG. 1, since cylinders 24 and 26 are both connected to shaft 30, the rotation of 30 will result in equal travel of both fabric pieces 14 and 16. However, in another embodiment of the present inventions (not shown) transport means may be provided to move the pieces of cloth independently of each other. In this embodiment, the misalignment indication signaled (that in the first embodiment is provided to the mechanical arm transducer) will be provided to adjust the speed of a fabric piece relative to the other fabric piece to obtain alignment.

Figure 2:
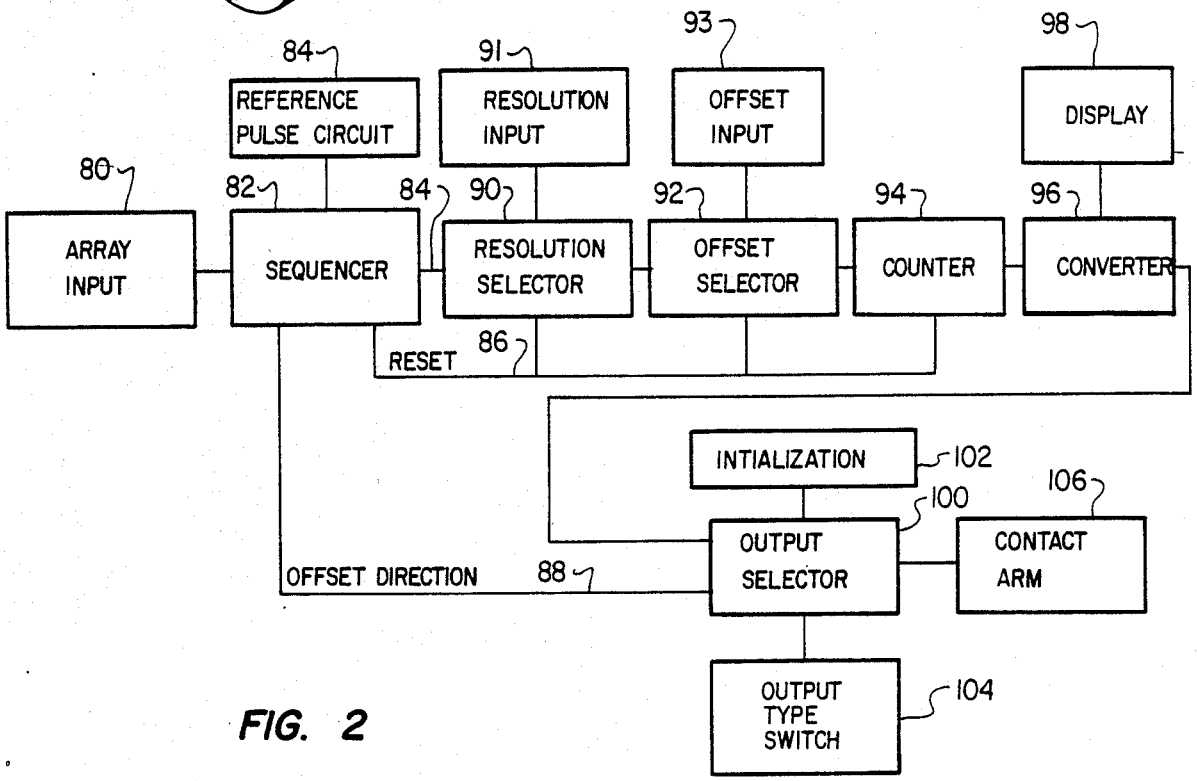
FIG. 2 is a block diagram of this invention.

FIG. 2 illustrates a block diagram of one embodiment of the present invention. In this embodiment, the light receiving diodes provide an array input 80 to a sequencer circuit 82. The sequencer circuit 82 further receives a series of reference pulses from the reference pulse circuit 84 indicating the travel of the fabric pieces along the path.

The reference pulse circuit 84 which provides the clock input from the shaft encoder illustrated in FIG. 1, indicates the travel of the fabric. By gating the input from the reference pulse circuit 84 by the array input circuit 80, the number of pulses gated will indicate the distance traveled between the uncovering of the first light emitter light detector combination and the time of the uncovering of the second light emitter light detector combination. This distance as measured by the reference pulse circuit 84 results in the actual offset distance specified in a series of pulses.

In the preferred embodiment, the array input 80 only provides a signal to the sequencer circuit 82 when one of the photo sensitive diodes receives light before the other. The sequencer circuit 82 then measures the distance traveled between the time that light is received by one photo sensitive diode to the time when light is received by the second as clocked by the pulses from circuit 84. The magnitude of this distance provides an offset magnitude signal on line 84 which is the series of pulses and is input to the resolution selector circuit 90. The resolution selector circuit 90 provides for operator adjustment of the resolution from the resolution input circuit 91 to adjust the overall correction signal provided to an alignment correction device.

The resolution of these pulses may be adjusted by the resolution selector circuit 90 by dividing by N, where N is a resolution input.

For example, if a misalignment of one tenth of an inch would produce 200 pulses, the resolution selector 90 may be used to reduce the number of pulses provided for adjustment of restraint to enable the operator to adjust the apparatus for different types of fabric requiring different levels of restraint for alignment. The output of the resolution selector 90 is provided to the offset selector circuit 92 which receives an operator input from the input circuit 93.

The offset selector circuit 92 allows the operator to predetermine the alignment offset desired. The offset selector input 93 provides the number M which designates a offset distance, measured in pulses from the speed indicator circuit 84, from matched alignment. Therefore, the offset selectors circuit 92 will not output any pulses to the counter 94 until this input offset distance has been achieved. The output of the offset selector circuit 92 is provided to counter 94 which accumulates the offset magnitude counts.

When the second photo sensitive diode of the pair is turned on the sequencer 82 receives this indication and provides a RESET signal on line 86 accordingly. The RESET signal on line 86 outputs the contents of the counter 94 to an operator display 98 and into a converter 96 which converts this digital signal into an analog signal through an output selector 100. The output selector 100 also receives an OFFSET DIRECTION signal 88 from the sequencer and provides a signal to the contact arm mechanism 106 which may result in either one of the contact arms 52 or 54 (FIG. 1) restraining travel of its respective fabric piece. In the preferred embodiment, an initialization circuit 102 is provided to specify the minimum and maximum force of the contact arms 106 on the fabric. Also, in this embodiment, an OUTPUT TYPE switch 104 is provided to select either a restraining force proportional to the magnitude of the offset signal or a full force applied for a specific time. In this embodiment, the time is a specific interval but it should be apparent to those skilled in the art that the time of restraint may be varied in accordance with the magnitude of these offset alignment signals.

Figure 3:
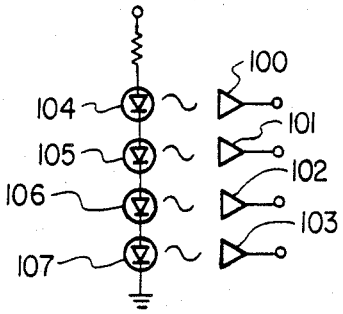
FIG. 3 is a schematic diagram of the positioned detector pairs.

FIG. 3 is a schematic diagram of the position detector circuit components which consists of four light emitting diodes 104–107, in the preferred embodiment (Part No. SEP8506-1) that emit light to four optical detectors 100–103, in the preferred embodiment (Part No. SDP8600). The light detectors in the preferred embodiment are configured with schmidt triggered circuits such that the output is either on or off. The pair assembly is located such that fabric which passes along the path will block the light transmission from the emitters to the detectors. Therefore, light will only travel after the end portion of the fabric has passed.

In the preferred embodiment, a path is provided for each fabric travel. Each path includes an individual set of light emitters and detectors having a corresponding locational relationship with emitters and detectors of the other path. Each path detector inputs the light indication signal into a logic circuit illustrated in FIG. 4. For example, referring back to FIG. 1, detectors 46 and 44, which are in a positional relation to each other, would input their signals to an EXCLUSIVE OR gate 110 which in turn provides an output to NAND gate 112 to OR gate 114 and finally to the bank NAND gate 116. Therefore, the EXCLUSIVE OR function of gate 110 will only provide an output when one or the other detector first receives light while the opposing detector is still covered. The output of gate 116 is the OFFSET COUNT signal. When both detectors at a location are uncovered the output of their EXCLUSIVE OR gate again becomes 0 resulting in the NOR gate 118 providing a RESET signal.

Figure 4:
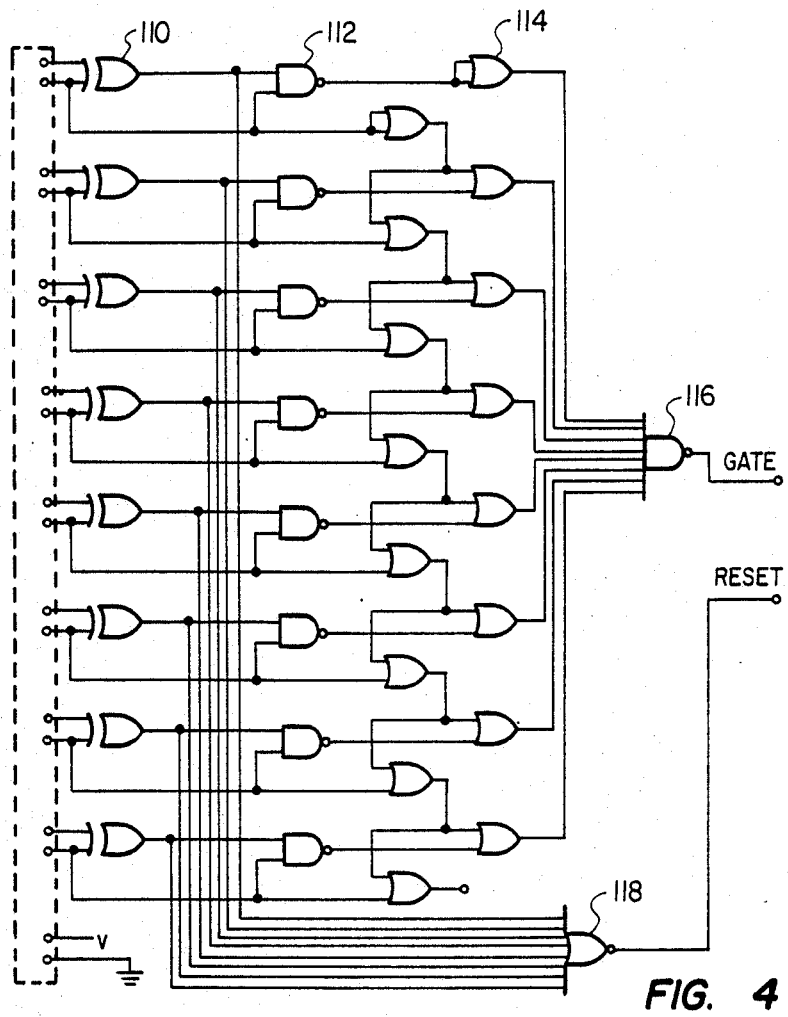
FIG. 4 is a schematic diagram of the positioned detection circuitry.
Figure 5:
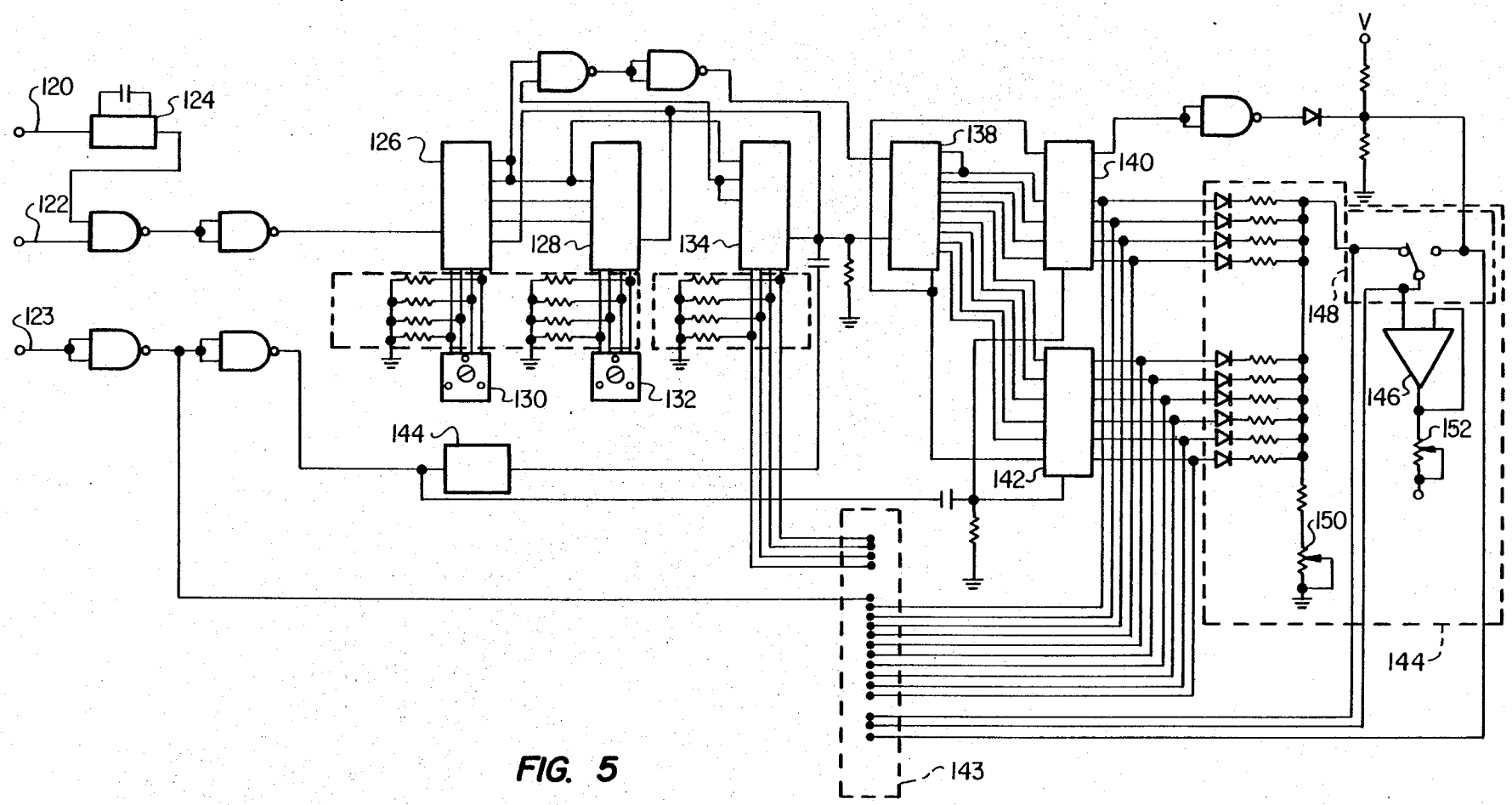
FIG. 5 is a schematic diagram of the offset circuitry.

The logic of FIG. 4 corresponds to the Input Array circuit 80 of FIG. 2. The output of this circuit, the GATE signal and RESET signal, are provided to the sequencer circuit 82 which is illustrated in FIG. 5. The sequencer circuit 82 receives not only the RESET and GATE inputs from the Array circuit 80 but also reference pulses from circuit 84 which it uses as a clock. The clock signal is the output of the shaft encoder illustrated in FIG. 1 and is input through a debounce circuit 124. In FIG. 5, the clock input is provided on terminal 122, the GATING signal on line 120 and the RESET signal on line 123. The clock and GATING signals are provided to counters 126 and 128, a 4522 circuit in the preferred embodiment, that are configured as a divide by N circuits where N is a resolution that is input by two switches 130 and 132. The output of this divide by N circuit or resolution selector circuit is provided to an offset selector circuit that includes counter 134, also a 4522. The offset selector circuit receives an operator input specifying an alignment offset represented by a number M. The counter 134 functions as a subtract by M circuit. The output of the offset selector counter 134 is provided to the counter 138 which is a frequency divider, Part No. 4017, that provides a parallel output to latches 140 and 142. This parallel output is provided to a digital to analog converter illustrated schematically as 144. Delay circuit 144 is provided to delay the RESET signal until the latched data has been output. This D/A converter includes a resistor ladder as shown that provides an output, when selected by switch 148, to amplifier 146 providing an output signal to a transducer. The D/A converter circuit 144 further includes a minimum force adjust switch 150 and a maximum force adjust switch 152. In the preferred embodiment, switch 148 is provided to vary the signal output to the transducer proportionally to the value stored in the latches 140 and 142 or to provide a maximum output as long as any alignment mismatch is detected.

Figure 6:
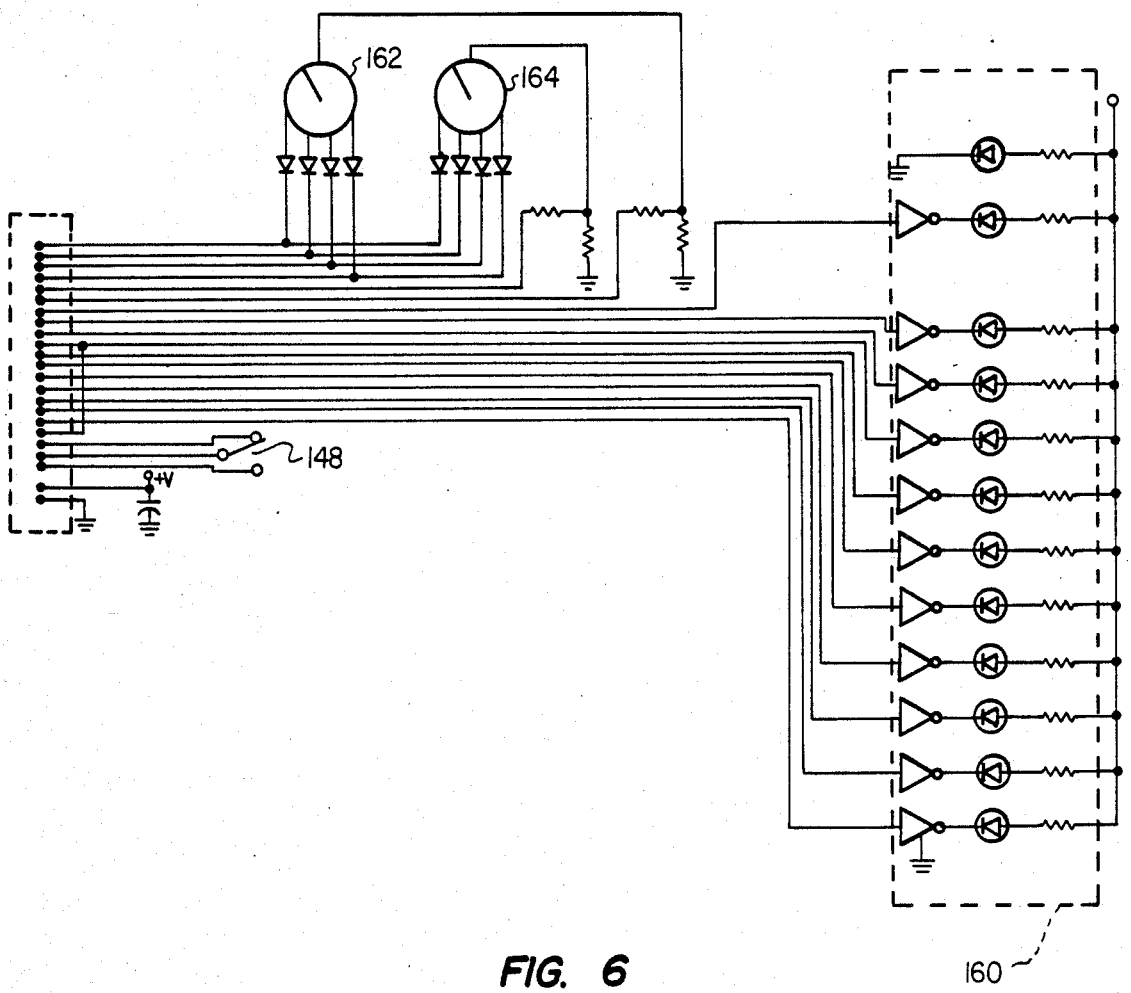
FIG. 6 is a schematic diagram of an operator display.

FIG. 6 illustrates a display 160 that is provided to the operator displaying the amount of restraint being applied. In FIG. 6, switches 162 and 164 are also provided which allow the operator to input the offset value M to the subtract by M circuit 134 in FIG. 5.

Figure 7:
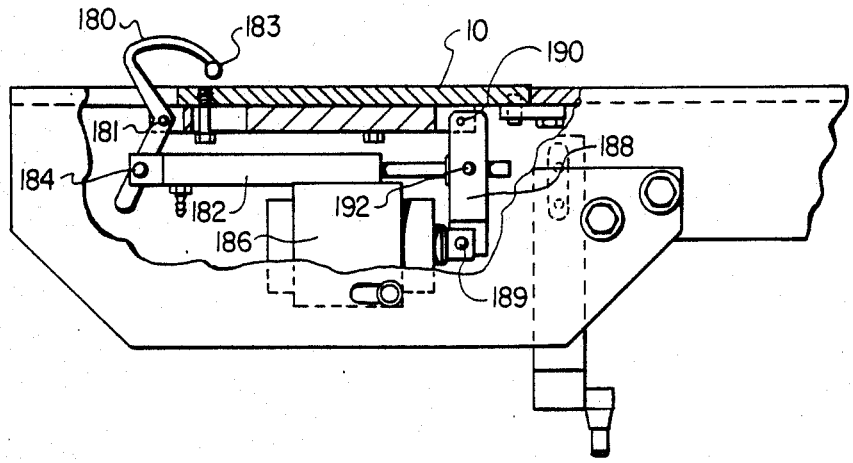
FIG. 7 is a side view of the alignment mechanical arm mechanism.

FIG. 7 illustrates the mechanical arm that is used to apply pressure to one of the fabrics to restrain the travel of the fabric. The arm 180 is pivoted about point 181 and connected by a pin 184 to a pneumatic cylinder 182. This cylinder is initially pneumatically charged to position the mechanical arm 180 over the fabric. The pneumatic cylinder 182 is connected by pin 192 to a lever arm 188 that is connected on one end to the table with pin 190 and on the other end to the transducer 186 by pin 189. The transducer 186 receives the signal from the output of the D/A converter 144 (FIG. 5) to move the mechanical arm 180 to restrain travel of the fabric. At the end of the mechanical arm 180 is located a drag finger 183. The drag finger 183 is a cylindrical shaft extending horizontally across the fabric path. When the mechanical arm 180 is engaged, the drag finger 183 presses against the top surface of the fabric to restrain the fabric travel.

In the preferred embodiment, the drag finger restrains the fabric movement provided by a sewing machine feed dog. In this embodiment, the reference pulse circuit 84 (FIG. 2) producing the shaft encoded pulses previously discussed is connected to the sewing machine drive shaft that powers the feed dog and produces 480 pulses per feed dog cycle. When the feed dog engages the fabric from below then the drag will restrain the fabric travel from above when activated.

Figure 8C:
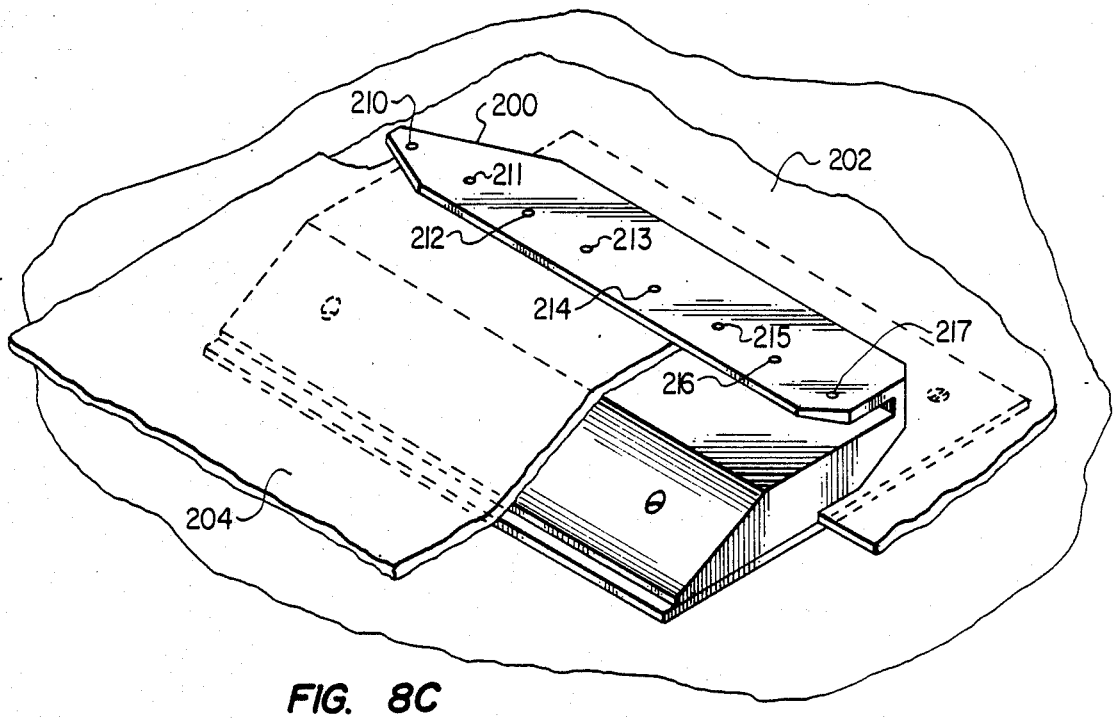
FIG. 8C is a isometric view of the fabric jig.
Figure 8A:
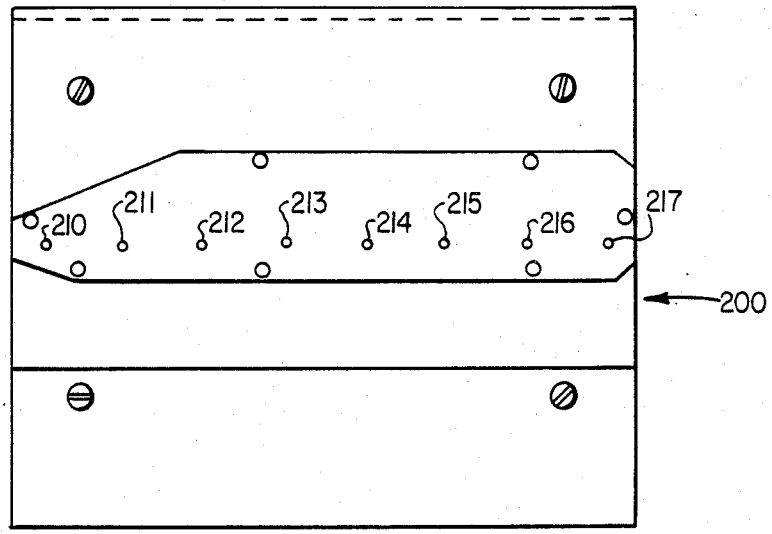
FIG. 8A is a plan view of a fabric jig.
Figure 8B:
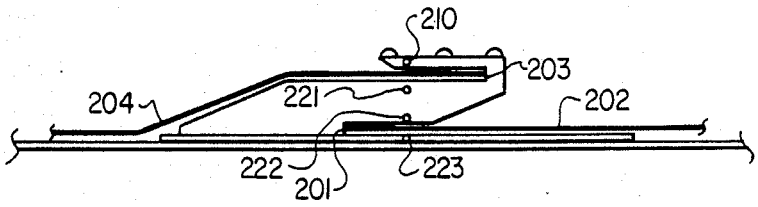
FIG. 8B is a side view of the fabric jig.

FIGS. 8A, 8B, and 8C illustrate a fabric jig 200 that is used to position one fabric piece 204 above another fabric piece 202 as the fabric pieces are being sewn. In the preferred embodiment, this jig includes the position detection circuit devices. FIG. 8A is a top view that illustrates the location of eight of the position detection devices. As previously explained, initially the fabric covers the space between the light emitter and the light detector devices inhibiting light transfer. The light transfer remains inhibited until the end portion of the fabric passes. In FIG. 8A, the position detection devices will each indicate the passage of the fabric end portion at eight separate locations. FIG. 8B illustrates the side view of the jig and further illustrates the vertical location of the light emitters and light detectors. In an embodiment, the light emitter 210 is positioned above the light detector 221 in the groove 203 of jig 200 which receives fabric piece 204. Fabric piece 202 is located underneath fabric piece 204 in groove 201 inhibiting the light transfer between the light emitter 222 and the light receiver 223. FIG. 8C is an isometric view of jig 200 illustrating the location of fabric pieces 202 and 204.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An apparatus to align a plurality of objects comprising:

transport means for moving the objects concomitantly over a predetermined path;

positional detection means located along the path for determining the actual relative positions of the objects and comparing the determined relative position to a predetermined relative position to be maintained;

said positional detection means being operable to provide an alignment correction signal correlated to the differential between said determined actual relative position and said relative position of the objects to be maintained; and repositioning means receiving the provided signal from said positional detection means and operable in response to receipt thereof for imposing a controlled resistance to the movement of at least one object along said path by said transport means.

2. An apparatus according to claim 1 wherein the alignment correction signal has a magnitude proportioned to a determined difference between the objects' actual relative positions and said predetermined relative positions for said repositioning means to impose a resistance force correlated to the magnitude of said received signal.

3. An apparatus according to claim 2 wherein said positional detection means includes a light source means located along the path for illuminating a plurality of light receivers wherein the light source and light receivers are positioned along the path so that the passage of the objects on the path will initially block light from the light source to the light receivers until the object has passed wherein each light receiver will sequentially be uncovered allowing light to pass between the source and the receiver.

4. An apparatus according to claim 3 wherein said light source means includes a plurality of light sources and the light sources and receivers are located in groups along the path, each group having a positional relationship to the other group wherein each group is located such that a single object will travel between the group's light sources and light receivers.

5. An apparatus according to claim 4 wherein said positional detection means provides an indication when one object end portion is traveling ahead of another object end portion along the path.

6. An apparatus according to claim 5 wherein the indication provided by the positional detection means represents the number of reference pulses occurring between one light source/light receiver in one group indicating the passage of the end of one object and a corresponding light source/light receiver indicating the passage of the end of another object.

7. An apparatus according to claim 1 wherein said repositioning means includes at least one mechanical arm located adjacent to the path to impose said controlled resistance against a moving object in accordance with the alignment correction signal.

8. An apparatus according to claim 7 wherein said mechanical arm is connected to a transducer that receives the alignment correction signal and in response thereto pivots the mechanical arm to impose said controlled resistance against the object in opposition to object movement effected by said transport means.

9. An apparatus according to claim 8 wherein said transducer is attached to a pneumatic means for initially positioning the arm adjacent to the path.

10. An apparatus according to claim 9 wherein the magnitude of the controlled resistance force imposed is proportional to the magnitude of the alignment correction signal.

11. An apparatus according to claim 9 wherein the controlled resistance force is maintained imposed for a time period that is proportional to the magnitude of the alignment correction signal.

12. An apparatus for aligning end portions of two pieces of fabric as the fabrics are being sewn together at a sewing station, the apparatus comprising:

transport means for moving the pieces of fabric along a predetermined path toward said sewing station;

positional detection means for providing a plurality of position signals, each indicating the position of the end portion of the respective fabric pieces as the end portions of the fabric pieces travel across specific locations along the predetermined path;

reference pulse means connected to the transport means for providing reference pulses indicating the fabric travel along the path;

offset circuit means connected to the reference means and the positional detection means for providing a positional difference signal indicating a relative positional difference between the end portions of the fabric pieces and which has a magnitude related to the difference between the actual relative positional difference and a predetermined relative positional difference value to be maintained; and alignment means operable in opposition to the fabric movement effected by said transport means for receiving said positional difference signal and restraining the travel of at least one of the pieces of fabric along the path in response to the positional difference signal thereby aligning the end portions of the two pieces of fabric as they travel along the path.

13. An apparatus according to claim 12 wherein the first fabric is located underneath the second fabric and the alignment means only restrains the travel of the first fabric.

14. An apparatus according to claim 13, including a travel path jig to locate the first fabric below the second fabric in a predetermined relation and having a first fabric travel path separate from a second fabric travel path.

15. An apparatus according to claim 14 wherein the positional detection means includes first and second groups of position detectors, each position detector group including a plurality of detector pairs, each pair including a light emitter device and a light receiver circuit means for providing an indication when light is received, said pairs of each group located along the first and second fabric travel paths respectively wherein each pair provides an indication when the end portion of the fabric has passed the pair location groups.

16. An apparatus according to claim 15 wherein the positional difference signal represents the distance between a fabric travel path pair indicating the passage of the end portion of one fabric and a corresponding fabric travel path pair indicating passage of the end portion of the other fabric.

17. An apparatus according to claim 16 wherein said alignment means includes a mechanical arm located above the lower fabric for restraining the travel of the lower fabric relative to the upper fabric.

18. An apparatus according to claim 17 wherein the mechanical arm is connected to a transducer which receives the positioned difference signal and in response thereto, pivots the mechanical arm to apply pressure against the lower fabric to restrain the lower fabric travel.

19. An apparatus according to claim 18 wherein the transducer is attached to a pneumatic means for initially positioning the arm adjacent to the lower fabric travel path.

20. An apparatus according to claim 19 wherein the magnitude of pressure is proportional to the magnitude of the positioned difference signal.

21. An apparatus according to claim 1 including pulse generation means for emitting pulses in response to the rate of object movement imposed by said transport means and said alignment correction signal is proportional to the number of pulses emitted by said pulse generation means in relation to the determined differential of said object positions.

22. An apparatus according to claim 21 wherein the objects comprise garment parts being advanced toward a sewing station and said differential represents a difference in actual position of a common end of the garment parts as compared to the predetermined position to be maintained.

23. An apparatus according to claim 21 in which said pulse generation means comprises encoder means operable to emit light pulses correlated to the linear speed imposed on the objects by said transport means.

24. An apparatus according to claim 21 including first adjustment means operable to presettably adjust the resolution of the relative position of the objects to be maintained.

25. An apparatus according to claim 24 including second adjustment means operable to presettably adjust the limits of the magnitude of controlled resistance imposed by said repositioning means against object movement by said transport means.

26. An apparatus according to claim 12 wherein said fabric pieces are moved by said transport means in said path in a side-by-side relation over a common plane.

27. An apparatus according to claim 26 wherein said alignment means includes a first mechanical arm operative for restraining the travel of one of the fabric pieces and a second mechanical arm operative for restraining the travel of the other of the fabric pieces.

28. An apparatus according to claim 12 wherein said position difference signal is proportional to the number of pulses emitted by said reference pulse means in relation to said relative positional difference in the position of the fabric end portions.

29. An apparatus according to claim 28 wherein said reference pulse means comprises encoder means operable to emit light pulses correlated to the linear speed imposed on the fabric pieces by said transport means.

30. An apparatus according to claim 28 including first adjustment means operable to presettably adjust the resolution of the relative positional difference value to be maintained.

31. An apparatus according to claim 30 including second adjustment means operable to presettably adjust the limits of restraint in the fabric piece operably imposed by said alignment means.

* * * * *